US008833766B2

(12) United States Patent
Hsu

(10) Patent No.: US 8,833,766 B2
(45) Date of Patent: Sep. 16, 2014

(54) PAPER PRESSING APPARATUS FOR PRINTING APPARATUS

(71) Applicant: Hon Hai Precision Industry Co., Ltd., New Taipei (TW)

(72) Inventor: Shao-Hung Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/895,364

(22) Filed: May 16, 2013

(65) Prior Publication Data

US 2014/0008866 A1 Jan. 9, 2014

(30) Foreign Application Priority Data

Jul. 6, 2012 (TW) ..... 101124336 A

(51) Int. Cl.
*B65H 5/02* (2006.01)
*B65H 5/36* (2006.01)
*B65H 5/06* (2006.01)

(52) U.S. Cl.
CPC . *B65H 5/36* (2013.01); *B65H 5/062* (2013.01)
USPC ..... 271/273

(58) Field of Classification Search
CPC .. B65H 5/06; B65H 5/062; B65H 2404/1341; B65H 2404/1342; B65H 2404/13421; B65H 2404/144; B65H 2404/1441; B65H 2404/1442; B65H 5/068
USPC ..... 271/273
See application file for complete search history.

(56) References Cited

U.S. PATENT DOCUMENTS

| | | | | |
|---|---|---|---|---|
| 6,139,011 | A * | 10/2000 | Huang et al. | 271/274 |
| 6,142,461 | A * | 11/2000 | Asao et al. | 270/58.09 |
| 6,929,261 | B2 * | 8/2005 | Nelson et al. | 271/273 |
| 7,264,240 | B1 * | 9/2007 | Lee | 271/273 |
| 7,427,065 | B2 * | 9/2008 | Maruyama | 271/273 |
| 7,448,623 | B2 * | 11/2008 | Ahn et al. | 271/273 |
| 8,444,134 | B1 * | 5/2013 | Huang | 271/3.14 |
| 8,500,122 | B2 * | 8/2013 | Kushida et al. | 271/274 |
| 8,579,276 | B2 * | 11/2013 | Huang | 271/3.14 |
| 2004/0169330 | A1 * | 9/2004 | Nelson et al. | 271/273 |
| 2007/0029725 | A1 * | 2/2007 | Marx et al. | 271/272 |
| 2011/0058870 | A1 * | 3/2011 | Murakami et al. | 399/361 |
| 2012/0248688 | A1 * | 10/2012 | Chng et al. | 271/258.02 |

* cited by examiner

*Primary Examiner* — Kaitlin Joerger
(74) *Attorney, Agent, or Firm* — Novak Druce Connolly Bove + Quigg LLP

(57) ABSTRACT

A paper pressing apparatus for a printing apparatus includes a bracket, a paper pressing member, a first gear, a first rolling arm, a second rolling arm, and a first elastic member. The paper pressing member is lifted up from the bracket to accommodate heavily creased or buckled papers, and then released to press the papers flat as they are drawn into the printer.

17 Claims, 6 Drawing Sheets

PAPER PRESSING APPARATUS FOR PRINTING APPARATUS

BACKGROUND

1. Technical Field

The present disclosure relates to printing technology.

2. Description of Related Art

A printing apparatus, such as a printer or a photocopying machine, feeds a sheet of paper from an input tray, prints an image on the paper, and discharges the printed paper to an output tray. A diagonal surface is used to smoothly guide the paper into the input tray. However, the diagonal surface cannot handle paper which are folded, have major creases, or need to be printed double-sided, thus the paper cannot be fed from the input tray smoothly, and the printing apparatus malfunctions.

Therefore, there is a need for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
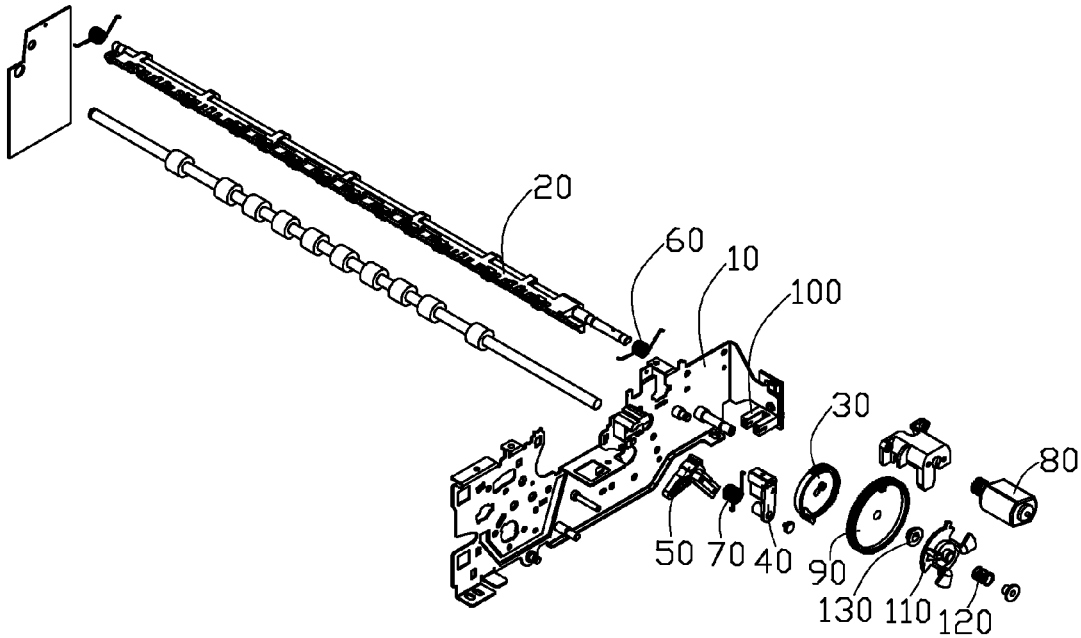
FIG. 1 is an exploded, isometric view of an embodiment of a paper pressing apparatus for a printing apparatus, the paper pressing apparatus comprising a bracket, a paper pressing member, a first gear, a first rolling arm, a second rolling arm, and two first elastic members.
Figure 2:
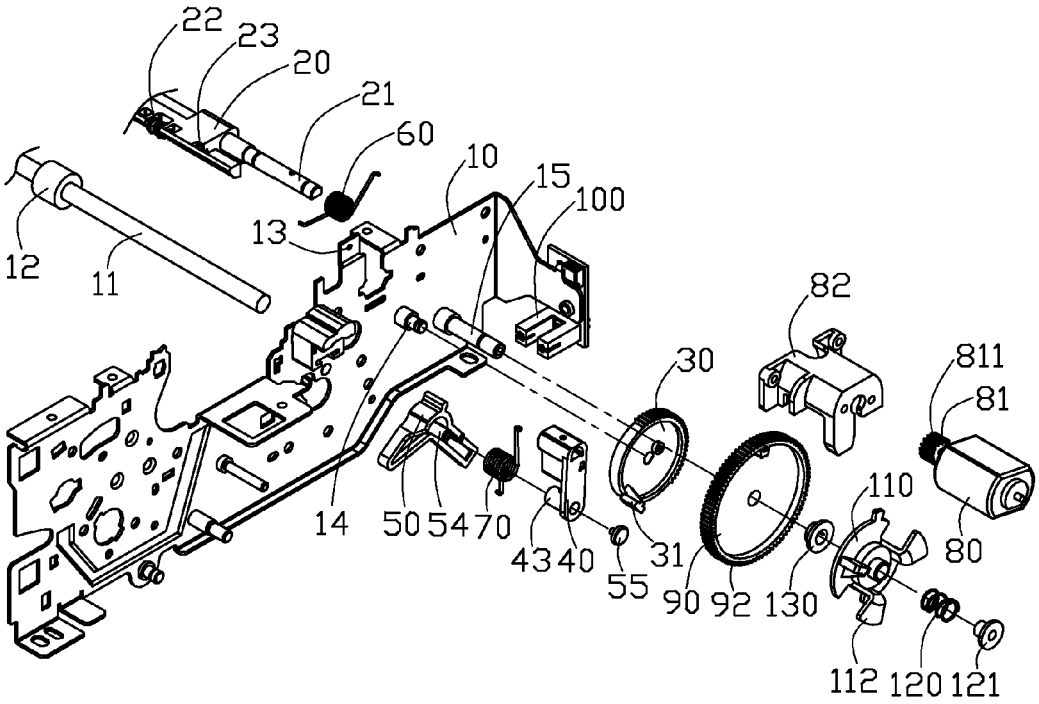
FIG. 2 is an exploded, isometric view of the paper-pressing apparatus of FIG. 1, viewed from one aspect.
Figure 3:
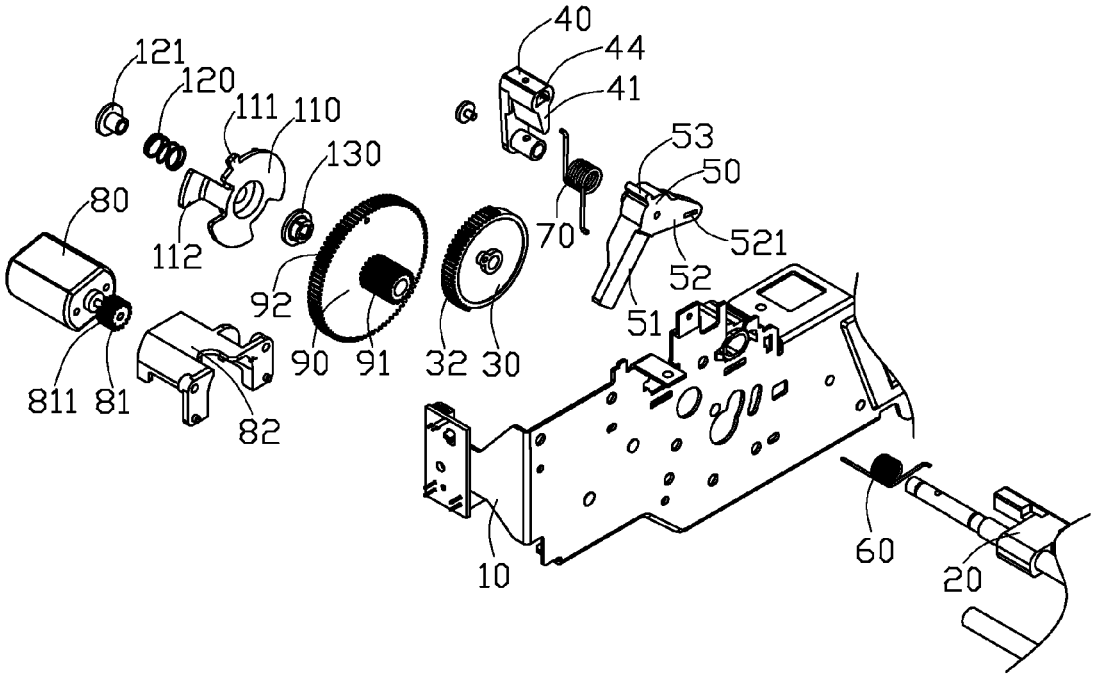
FIG. 3 is an exploded, isometric view of the paper-pressing apparatus of FIG. 1, viewed from another aspect.
Figure 4:
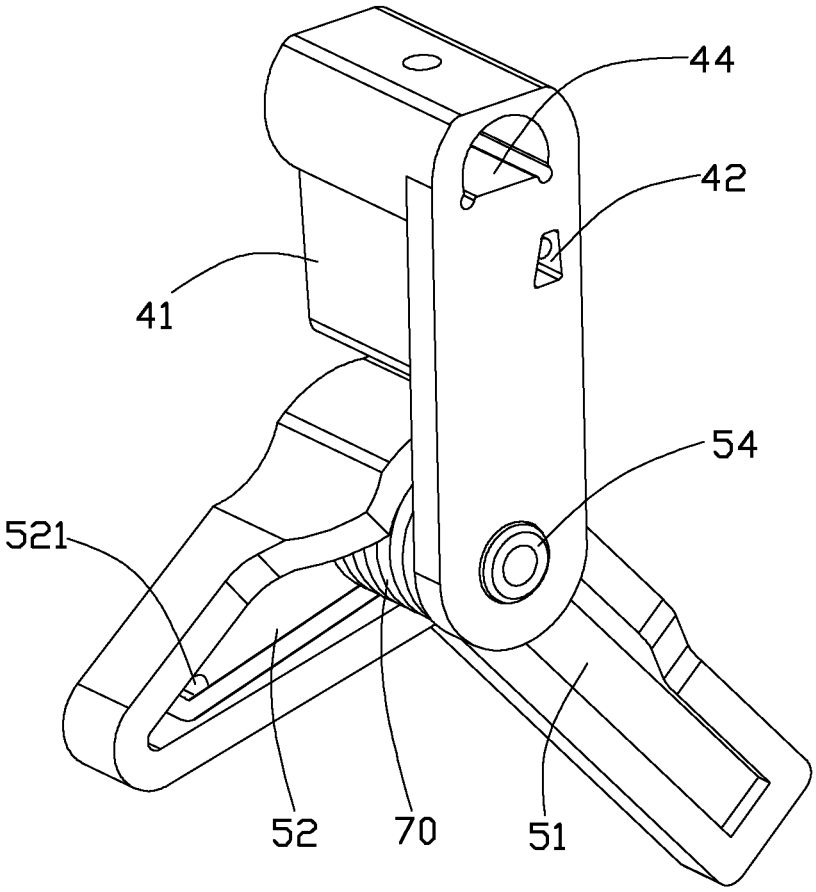
FIG. 4 is an assembled view of the first rolling arm and the second rolling arm of FIG. 1.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

FIGS. 1 to 4 show a paper pressing apparatus for printing apparatuses for supporting a plurality of papers (not shown). The paper pressing apparatus includes a bracket 10, a paper pressing member 20 movably fixed on the bracket 10, a first gear 30 fixed on the bracket 10, a first rolling arm 40 connected to the paper pressing member 20, a second rolling arm 50 movably connected to the first gear 30 and the first rolling arm 40, and two first elastic members 60 connected to the bracket 10 and the paper pressing member 20.

A resisting portion 31 and a plurality of first teeth 32 are formed on the first gear 30. A first protrusion portion 41 is formed on the first rolling arm 40. A first mounting slot 42 is defined in the first rolling arm 40. The second rolling arm 50 comprises a resisting arm 51 and a rotating arm 52 extending from the resisting arm 51. A second protrusion portion 53 is formed on the second rolling arm 50 corresponding to the first protrusion portion 41. A second mounting slot 521 is defined in the rotating arm 52. A second elastic member 70 is mounted to engage with the first rolling arm 40 and the second rolling arm 50. Distal ends of the second elastic member 70 are mounted in the first mounting slot 42 and the second mounting slot 521. A circular pivoting portion 43 is formed on the first rolling arm 40. A circular pivoting axis 54 is formed on the second rolling arm 50 corresponding to the pivoting portion 43. In one embodiment, a diameter of the pivoting axis 54 is less than that of the pivoting portion 43.

The bracket 10 has a first rotating axis 11. A motor 80, a driving member 90, and a photosensitive member 100 are mounted on the bracket 10. A plurality of paper output rollers 12 are mounted on the first rotating axis 11. The paper pressing member 20 includes a second rotating axis 21 and a plurality of paper pressing rollers 22 mounted on the second rotating axis 21. Two third mounting slots 23 are defined in the paper pressing member 20 corresponding to the two first elastic members 60. Two fourth mounting slots 13 are defined in the bracket 10 corresponding to the two first elastic members 60. Distal ends of each of the two first elastic members 60 are mounted in the third mounting slot 23 and the fourth mounting slot 13. A mounting hole 44 is defined in the first rolling arm 40 corresponding to the second rotating axis 21. A second gear 81 is mounted on the motor 80. A plurality of second teeth 811 are formed on the second gear 81. The motor 80 is mounted to the bracket 10 by a motor base 82. A plurality of third teeth 91 are formed on the driving member 90 corresponding to the plurality of first teeth 32. A plurality of fourth teeth 92 are formed on the driving member 90 corresponding to the plurality of second teeth 811. A third protrusion portion 93 is formed on the driving member 90. A control plate 110 is mounted on the driving member 90. A resisting plate 111 extends from the control plate 110 corresponding to the third protrusion portion 93. Two light shielding plates 112 extend from the control plate 110 corresponding to the photosensitive member 100. A third elastic member 120 is mounted on one side of the control plate 110. The third elastic member 120 is mounted on the control plate 110 by means of a mounting base 121. A friction plate 130 is mounted on another side of the control plate 110. A third rotating axis 14 is formed on the bracket 10 corresponding to the first gear 30. A fourth rotating axis 15 is formed on the bracket 10 corresponding to the driving member 90.

Figure 5:
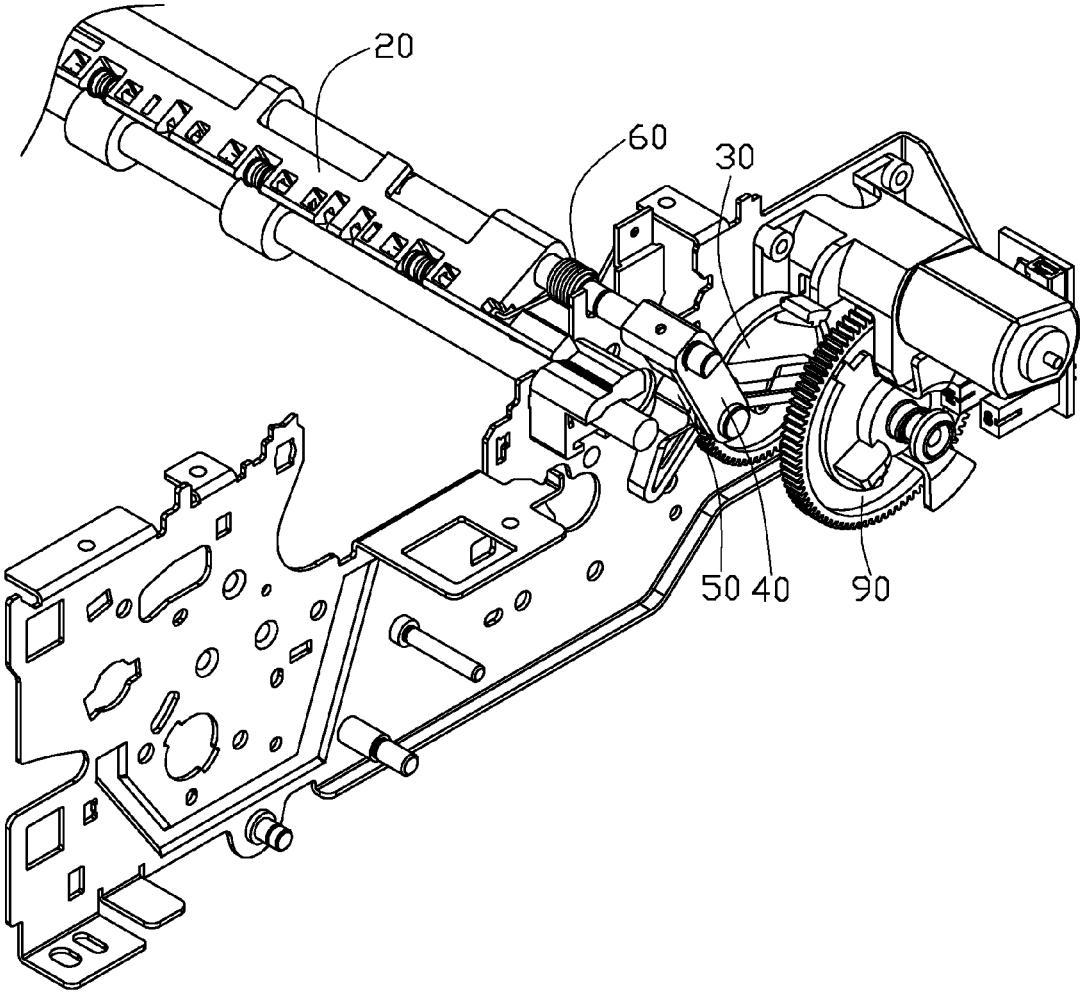
FIG. 5 is an assembled view of the paper pressing apparatus of FIG. 2, with the paper pressing member lifted up from the bracket.
Figure 6:
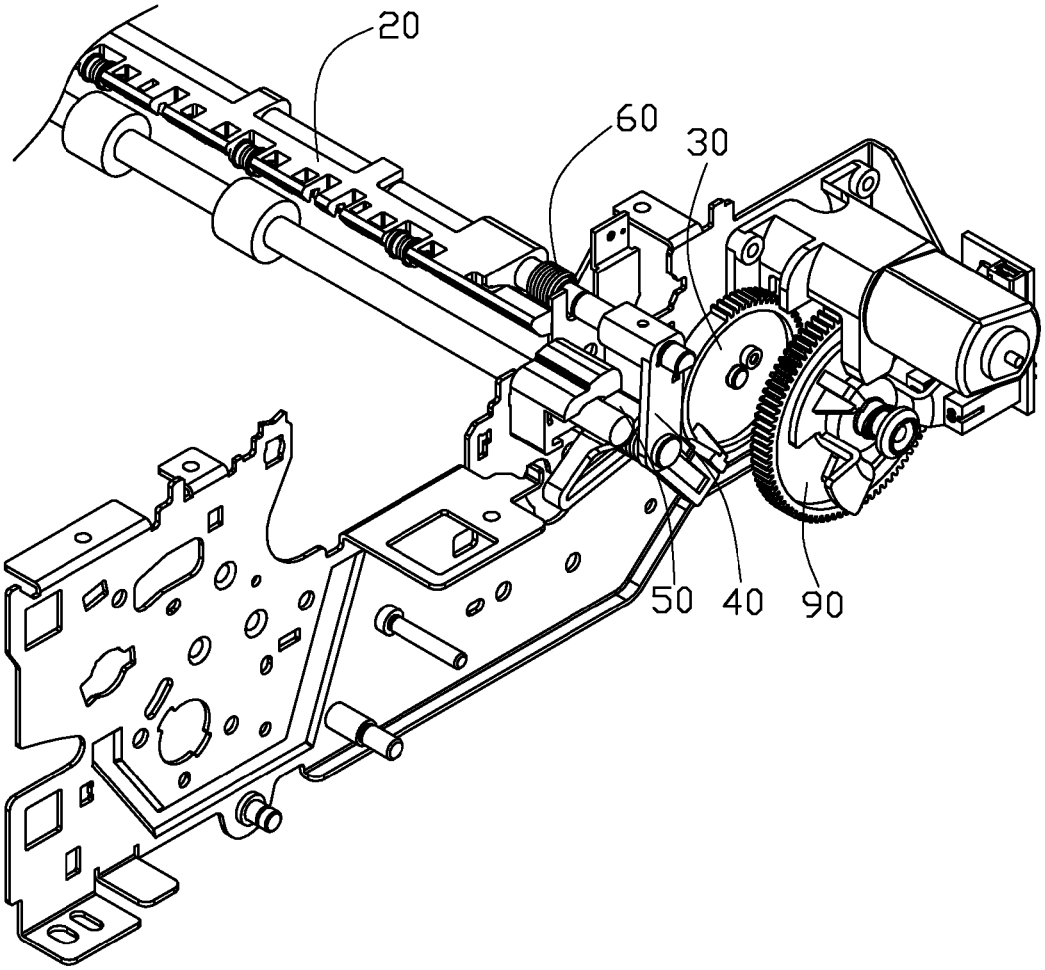
FIG. 6 is an assembled view of the paper pressing apparatus of FIG. 2, with the paper pressing member lying down on the bracket.

Referring to FIGS. 5 and 6, in assembly, the first gear 30 is mounted on the third rotating axis 14. The friction plate 130, the driving member 90, and the control plate 110 are mounted in sequence on the fourth rotating axis 15. The first gear 30 and the driving member 90 are mounted on the bracket 10. The second rotating axis 21 passes through the mounting hole 44. The pivoting axis 54 passes through the pivoting portion 43. A fastener 55 passes through the pivoting axis 54 to mount the first rolling arm 40 and the second rolling arm 50 onto the bracket 10.

In operation, the motor 80 is powered on to drive the second gear 81 to rotate counterclockwise. The plurality of second teeth 811 engage with the plurality of fourth teeth 92. The second gear 81 rotates the driving member 90 clockwise. The plurality of third teeth 91 engage with the plurality of first teeth 32. The driving member 90 rotates the first gear 30 counterclockwise. The resisting portion 31 resists against the resisting arm 51. The second rolling arm 50 on the bracket 10 moves toward the left. The second protrusion portion 53 resists against the first protrusion portion 41. The second rolling arm 50 drives the first rolling arm 40 and the second rotating axis 21 to rotate clockwise. The two first elastic members 60 are thus elastically deformed. The second rotating axis 21 and the paper pressing rollers 22 are thereby lifted up from the bracket 10.

The motor 80 is powered on to rotate the second gear 81 clockwise. The second gear 81 rotates the driving member 90 counterclockwise. The driving member 90 rotates the first gear 30 clockwise. The resisting portion 31 releases the resisting arm 51. The second rolling arm 50 on the bracket 10 moves toward the right. The second protrusion portion 53 releases the first protrusion portion 41. The two first elastic members 60 elastically restore. The first rolling arm 40 and the second rotating axis 21 rotate counterclockwise. The second rotating axis 21 and the paper pressing rollers 22 are thus moved down on the bracket 10 to press the papers flat as they are drawn into the printing apparatus.

During the working process, when the driving member 90 rotates and the third protrusion portion 93 resists against the resisting plate 111, the driving member 90 rotates the control plate 110. The two light shielding plates 112 are at different positions on the control plate 110 when the second rotating axis 21 and the paper pressing rollers 22 are lifted up and then moved down. Thus the photosensitive member 100 detects status of the paper pressing member 20 by sensing positions of the two light shielding plates 112 on the control plate 110. When the motor 80 stops rotating, the third elastic member 120 assists in decreasing friction between the driving member 90 and the control plate 110. The friction plate 130 reduces friction between the fourth rotating axis 15 and the driving member 90. Therefore the precision of the photosensitive member 100 in detecting the status of the paper pressing member 20 is improved. In one embodiment, the first elastic members 60 and the second elastic member 70 are torsion springs. The third elastic member 120 is a compression spring.

Even though numerous characteristics and advantages of the present disclosure have been set forth in the foregoing description, together with details of the structure and function of the disclosure, the disclosure is illustrative only, and changes may be made in detail, especially in the matters of shape, size, and the arrangement of parts within the principles of the disclosure to the full extent indicated by the broad general meaning of the terms in which the appended claims are expressed.

What is claimed is:

1. A paper pressing apparatus for a printing apparatus comprising:

a bracket;

a paper pressing member movably secured to the bracket;

a first gear fixed on the bracket;

a first rolling arm connected to the paper pressing member;

a second rolling arm movably connected to the first gear and the first rolling arm;

a first elastic member connected to the bracket and the paper pressing member; and a resisting portion formed on the first gear, wherein when the first gear rotates along a first direction, the resisting portion resists against the second rolling arm, the second rolling arm moves toward a second direction on the bracket, the second rolling arm drives the first rolling arm and the paper pressing member rotating along a third direction, the first elastic member is elastically deformed, and the paper pressing member is lifted up from the bracket; and when the first gear rotates along the third direction, the resisting portion releases the second rolling arm, the second rolling arm moves toward a fourth direction on the bracket, the first elastic member is elastically returned, the first rolling arm and the paper pressing member rotate along the first direction, and the paper pressing member is lain down on the bracket.

2. The paper pressing apparatus of claim 1, further comprising a second elastic member mounted on the first rolling arm and the second rolling arm; when the resisting portion resists against the second rolling arm, the second elastic member is elastically deformed; and when the resisting portion releases the second rolling arm, the second elastic member is elastically returned, and the second rolling arm moves toward the fourth direction.

3. The paper pressing apparatus of claim 2, further comprising a first protrusion portion on the first rolling arm and a second protrusion portion on the second rolling arm corresponding to the first protrusion portion; and the second protrusion portion resists against the first protrusion portion when the second rolling arm moves toward the second direction.

4. The paper pressing apparatus of claim 3, wherein the first rolling arm comprises a first mounting slot; the second rolling arm comprises a resisting arm and a rotating arm extending from the resisting arm; the rotating arm comprises a second mounting slot; and two distal ends of the second elastic member are mounted in the first mounting slot and the second mounting slot respectively.

5. The paper pressing apparatus of claim 4, wherein the paper pressing member comprises a third mounting slot; the bracket comprises a fourth mounting slot; and two distal ends of the two first elastic members are mounted in the third mounting slot and the fourth mounting slot.

6. The paper pressing apparatus of claim 5, further comprising a first rotating axis mounted on the bracket; a plurality of paper output rollers are mounted on the first rotating axis; and the paper pressing member comprises a second rotating axis and a plurality of paper pressing rollers mounted on the second rotating axis.

7. The paper pressing apparatus of claim 6, further comprising a pivoting portion on the first rolling arm and a pivoting axis on the second rolling arm corresponding to the pivoting portion; the pivoting axis passes through and received in the pivoting portion; the first rolling arm comprises a mounting hole corresponding to the second rotating axis; and the second rotating axis passes through and received in the mounting hole.

8. The paper pressing apparatus of claim 7, further comprising a motor and a driving member mounted on the bracket; the first gear comprises a plurality of first teeth; a second gear is mounted on the motor; the second gear comprises a plurality of second teeth; the driving member comprises a plurality of third teeth corresponding to the plurality of first teeth and a plurality of fourth teeth corresponding to the plurality of second teeth; and the motor rotates the first gear by the second gear and the driving member.

9. The paper pressing apparatus of claim 8, further comprising a control plate mounted on the driving member and a photosensitive member mounted on the bracket; the driving member further comprises a third protrusion portion; the control plate comprises a resisting plate corresponding to the third protrusion portion, and a light shielding plate corresponding to the photosensitive member; when the driving member rotates and the third protrusion portion resists against the resisting plate, the driving member rotates the control plate, and the photosensitive member detects status of the paper pressing member by positions of the two light shielding plates on the control plate.

10. A paper pressing apparatus for a printing apparatus comprising:

a bracket;

a paper pressing member movably fixed on the bracket;

a first gear fixed on the bracket and comprising a resisting portion;

a first rolling arm connected to the paper pressing member; wherein the first rolling arm has a first protrusion portion formed thereon;

a second rolling arm movably connected to the first gear and the first rolling arm, and comprising a second protrusion portion; and a first elastic member connected to the bracket and the paper pressing member, wherein when the first gear rotates along a first direction, the resisting portion resists against the second rolling arm, the second rolling arm moves toward a second direction on the bracket, the second protrusion portion resists against the first protrusion portion, the second rolling arm rotates the first rolling arm and the paper pressing member along a third direction, the first elastic member is elastically deformed, and the paper pressing member is lifted up from the bracket; and when the first gear rotates along the third direction, the resisting portion releases the second rolling arm, the second rolling arm moves toward a fourth direction on the bracket, the first elastic member is elastically returned, the first rolling arm and the paper pressing member rotates along the first direction, and the paper pressing member is lain down on the bracket.

11. The paper pressing apparatus of claim 10, further comprising a second elastic member mounted on the first rolling arm and the second rolling arm; when the resisting portion resists against the second rolling arm, the second elastic member is elastically deformed; and when the resisting portion releases the second rolling arm, the second elastic member is elastically returned, and the second rolling arm moves toward the fourth direction.

12. The paper pressing apparatus of claim 11, wherein the first rolling arm comprises a first mounting slot; the second rolling arm comprises a resisting arm and a rotating arm extending from the resisting arm; the rotating arm comprises a second mounting slot; and two distal ends of the second elastic member are mounted in the first mounting slot and the second mounting slot respectively.

13. The paper pressing apparatus of claim 12, wherein the paper pressing member comprises a third mounting slot; the bracket comprises a fourth mounting slot; and two distal ends of the two first elastic member are mounted in the third mounting slot and the fourth mounting slot.

14. The paper pressing apparatus of claim 13, further comprising a first rotating axis mounted on the bracket; a plurality of paper output rollers are mounted on the first rotating axis; and the paper pressing member comprises a second rotating axis and a plurality of paper pressing rollers mounted on the second rotating axis.

15. The paper pressing apparatus of claim 14, further comprising a pivoting portion on the first rolling arm and a pivoting axis on the second rolling arm corresponding to the pivoting portion; the pivoting axis passes through and is received in the pivoting portion; the first rolling arm comprises a mounting hole corresponding to the second rotating axis; and the second rotating axis passes through and received in the mounting hole.

16. The paper pressing apparatus of claim 15, further comprising a motor and a driving member mounted on the bracket; the first gear comprises a plurality of first teeth; a second gear is mounted on the motor; the second gear comprises a plurality of second teeth; the driving member comprises a plurality of third teeth corresponding to the plurality of first teeth, and a plurality of fourth teeth corresponding to the plurality of second teeth; and the motor rotates the first gear by the second gear and the driving member.

17. The paper pressing apparatus of claim 16, further comprising a control plate mounted on the driving member and a photosensitive member mounted on the bracket; the driving member further comprises a third protrusion portion; the control plate comprises a resisting plate corresponding to the third protrusion portion, and a light shielding plate corresponding to the photosensitive member; when the driving member rotates and the third protrusion portion resists against the resisting plate, the driving member rotates the control plate; and the photosensitive member detects a status of the paper pressing member by positions of the two light shielding plates on the control plate.

* * * * *